US005334099A

United States Patent [19]

Marra et al.

[11] Patent Number: 5,334,099

[45] Date of Patent: Aug. 2, 1994

[54] RESTRAINING BAR ASSEMBLY FOR A SWING

[75] Inventors: Mark A. Marra; Robert L. Quinlan, Jr., both of Stow, Ohio

[73] Assignee: The Little Tikes Company, Hudson, Ohio

[21] Appl. No.: 940,638

[22] Filed: Sep. 4, 1992

[51] Int. Cl.[5] ..... A63G 9/00

[52] U.S. Cl. ..... 472/118; 297/467; 24/650

[58] Field of Search ..... 472/118, 119, 120, 121, 472/122, 100; 297/467, 250; 24/643, 647, 650

[56] References Cited

U.S. PATENT DOCUMENTS

| | | | |
|---|---|---|---|
| D. 202,280 | 9/1965 | Horowitz | D34/15 |
| 256,087 | 4/1882 | Wiesenmeyer | 24/650 |
| 4,393,555 | 7/1983 | Föhl | 24/643 |
| 4,632,460 | 12/1986 | Meeker et al. | 297/467 |
| 4,650,246 | 3/1987 | Henrikson | 297/250 |
| 4,858,997 | 8/1989 | Shubin | 297/467 |
| 5,181,765 | 1/1993 | Glover | 297/467 |

OTHER PUBLICATIONS

"Little Tikes-Toys That Last", The Little Tikes Company, Hudson, Ohio 44236, 1991.

"Fisher-Price-Spring 1991", Fisher-Price, East Aurora, N.Y. 14052, 1990.

*Primary Examiner*—Carl D. Friedman

*Assistant Examiner*—Kien Nguyen

*Attorney, Agent, or Firm*—Renner, Kenner, Greive, Bobak, Taylor & Weber

[57] ABSTRACT

A toddler swing (10) includes a restraining bar assembly (11) having a cross bar (12) and a lower extension member (13), the restraining bar assembly (11) being positively attached to and releasable from the swing (10). A latch mechanism (19) connects the lower extension member (13) to the seat (14) of the swing (10) by engaging a generally J-shaped hook (25) of the lower extension member (13) with a generally J-shaped catch (21) located beneath the seat (14) of the swing (10) as part of a spring (20). In addition, the restraining bar assembly (11) includes bosses (34) formed on the cross bar (12) of the restraining bar assembly (11) to be received in recesses (38) in the arm rests (16) of the swing (10). Together, the latch mechanism (19) and the bosses (34) positively position and hold the restraining bar assembly (11) in place.

12 Claims, 4 Drawing Sheets

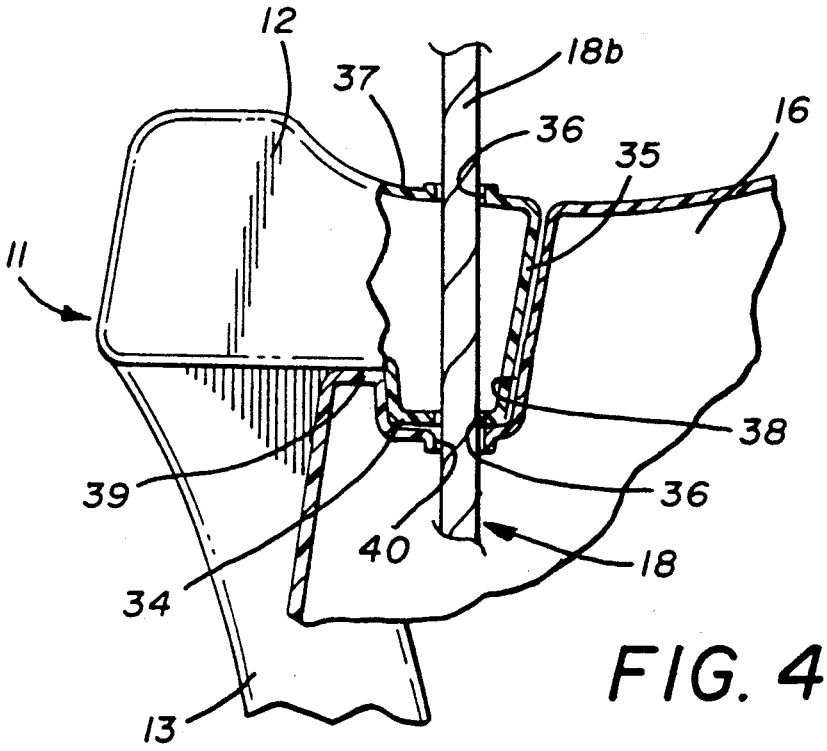
FIG. 4
FIG. 3
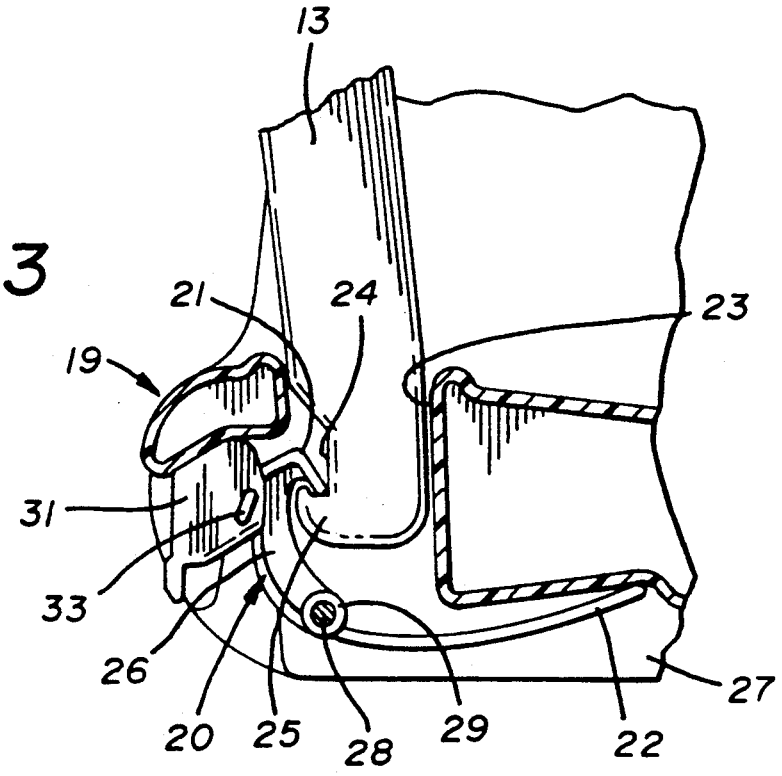

RESTRAINING BAR ASSEMBLY FOR A SWING

TECHNICAL FIELD

This invention relates to a restraining bar assembly for a toddler swing. More particularly, this invention relates to a restraining bar assembly which is positively attached to the toddler swing such that a toddler cannot forcefully release the restraining bar assembly from the swing, thereby preventing the toddler from potentially falling out of the swing.

BACKGROUND ART

Many swings made for toddlers are provided with restraining bar assemblies which are generally designed to prevent a child from falling out of the swing. For example, one well known restraining mechanism utilizes a cross bar and a strap. The cross bar is connected to the ropes of the swing and may be lifted up to allow the child to be seated in the swing. The cross bar is then lowered in front of the child to prevent him from falling forward, out of the swing. Because the child may attempt to lift the cross bar while he is in the swing, a strap may be placed between the child's legs to connect the cross bar to the seat of the swing. Not only does this prevent the child from lifting the cross bar, it also precludes the child from sliding under the cross bar to get out of the swing.

While such a device has been effective for the purposes described hereinabove, it is not without its problems. For example, not only is the separate strap susceptible to being lost, but also significant inconvenience is caused by having to buckle and unbuckle the straps upon use of the swing. Moreover, having to make both the cross bar and the strap adds significantly to the cost of the product. More importantly, the restraining cross bar is not positively connected or secured to the swing, thereby potentially allowing the child to forcefully reposition the cross bar so that he could get out of the swing without unbuckling the strap.

To eliminate at least some of these problems, a T-bar has been used as an effective restraining implement. The T-bar, which generally incorporates the cross bar and strap into one piece, is used in essentially the same manner as the cross bar and strap except that a lower extension member is integrally connected to the cross bar, thereby forming the T shape.

Most known T-bar restraining assemblies for swings engage the seat of the swing between the child's legs as did the strap previously. Most T-bar restraining assemblies are designed with a latch or locking mechanism wherein an aperture in the seat is adapted to receive the lower extension member of the T-bar. For example, one known swing utilizes a latch or locking mechanism wherein the lower extension member of the T-bar includes a small recess in its front surface and a protruding lip near the bottom of its back surface. The lower extension member of the T-bar is received by the aperture in the upper front portion of the seat of the swing. Within the aperture is positioned at least two downward extending plates integrally connected to the seat. The first plate extends from the front side of the opening in relation to the seat and the second plate extends from the back side of the opening in relation to the seat. A small lip extends from the first plate to be received by the small recess in the front surface of the lower extension member of the T-bar when in the closed position. Furthermore, the protruding lip on the back surface of the T-bar extends past the lower edge of the back plate when the T-bar is in the closed position so as to preclude the T-bar from being easily disengaged. To release the T-bar, the person helping the child must squeeze the first plate and front edge of the swing together, thereby releasing the small lip in the first plate from the small recess in the lower extension member, so that the T-bar may be disengaged from the swing.

However, these known T-bar restraining assemblies do not provide the desirable total positive engagement with the swing. No other part of the T-bar engages the swing. Thus, a child may be capable of forcefully pushing the cross bar component of the T-bar away from the arm rests of the swing resulting in the possibility of the child falling out of the swing or possibly pinching his fingers between the cross bar and the arm rests of the swing.

Therefore, the need exists for a restraining bar assembly which more positively engages the swing at more than one point, and which provides a latch mechanism which is not as subject to accidental manipulation as is the case in prior mechanisms.

DISCLOSURE OF THE INVENTION

It is therefore a primary object of the present invention to provide a restraining bar assembly for a toddler swing which prevents a child from falling out of the swing.

It is another object of the present invention to provide a restraining bar assembly, as above, which positively attaches to the swing at more than one point.

It is a further object of the present invention to provide a restraining bar assembly, as above, which more positively engages the swing with a latch mechanism to connect the lower extension member of the restraining member to the swing and with positioning guide means to connect the cross bar to the arm rests of the swing.

It is yet another object of the present invention to provide a restraining bar assembly, as above, in which the latch mechanism is less likely to be accidentally manipulated.

These and other objects of the present invention, as well as the advantages thereof over existing prior art forms, which will become apparent from the description to follow, are accomplished by the invention as hereinafter described and claimed.

In general, a restraining bar assembly for a toddler swing which has a seat and arm rests includes a T-bar which includes a cross bar and a lower extension member. A latch mechanism connects the lower extension member to the seat of the swing and includes spring means attached to and biased against the swing for engaging the lower extension member. Positioning guide means are provided for aligning and securing the cross bar to the arm rests of the swing.

A preferred exemplary restraining bar assembly incorporating the concepts of the present invention is shown by way of example in the accompanying drawings without attempting to show all of the various forms and modifications in which the invention might be embodied, the invention being measured by the appended claims and not by the details of the specification.

BRIEF DESCRIPTION OF THE DRAWINGS

FIG. 3 is an enlarged fragmented sectional view showing some parts in elevation, and taken substantially along the line 3—3 of FIG. 2.

FIG. 4 is an enlarged fragmented sectional view taken substantially along line 4—4 of FIG. 2.

PREFERRED EMBODIMENT FOR CARRYING OUT THE INVENTION

Figure 1:
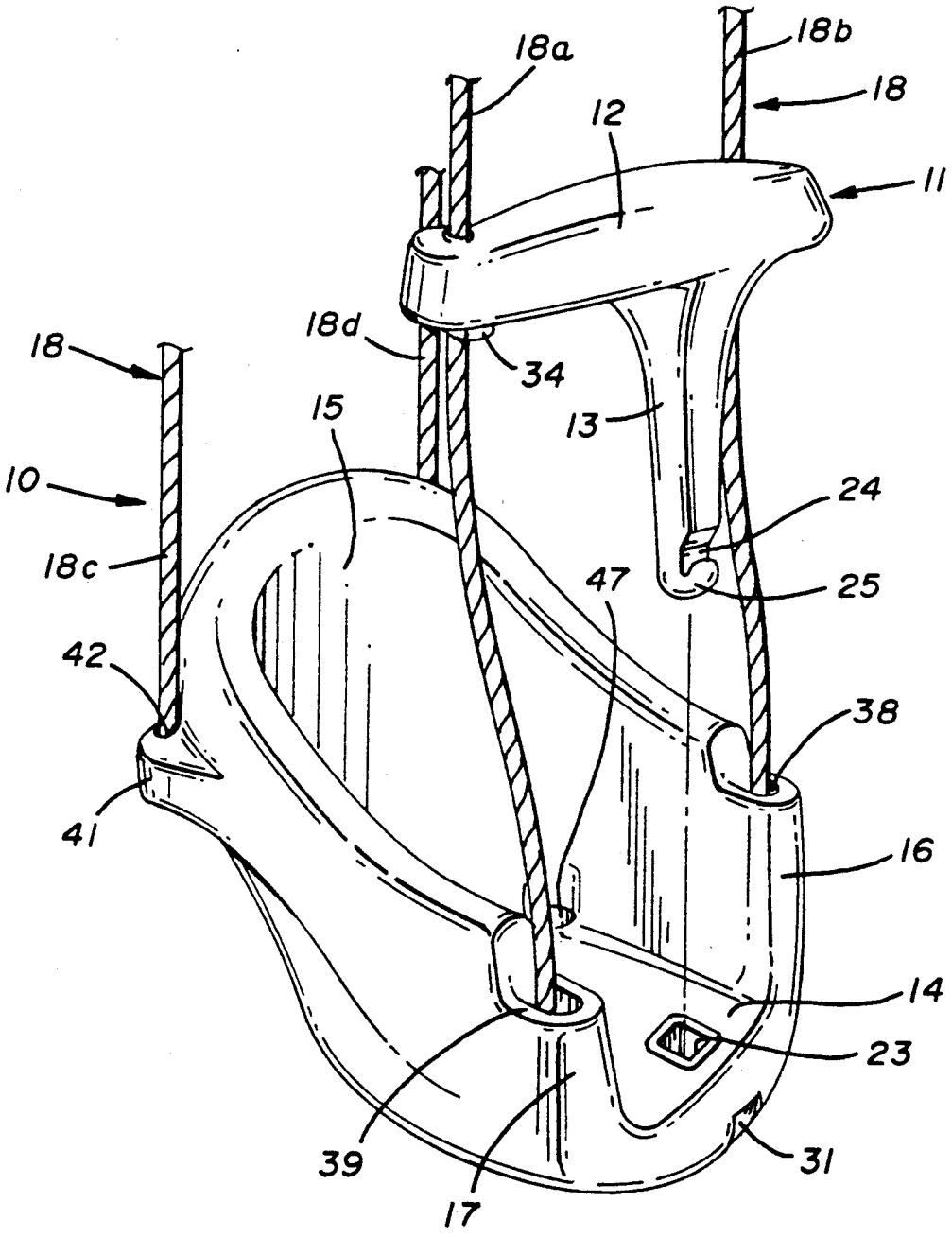
FIG. 1 is a perspective view of a swing showing the restraining bar assembly made in accordance with the concepts of the present invention in its disengaged position.
Figure 2:
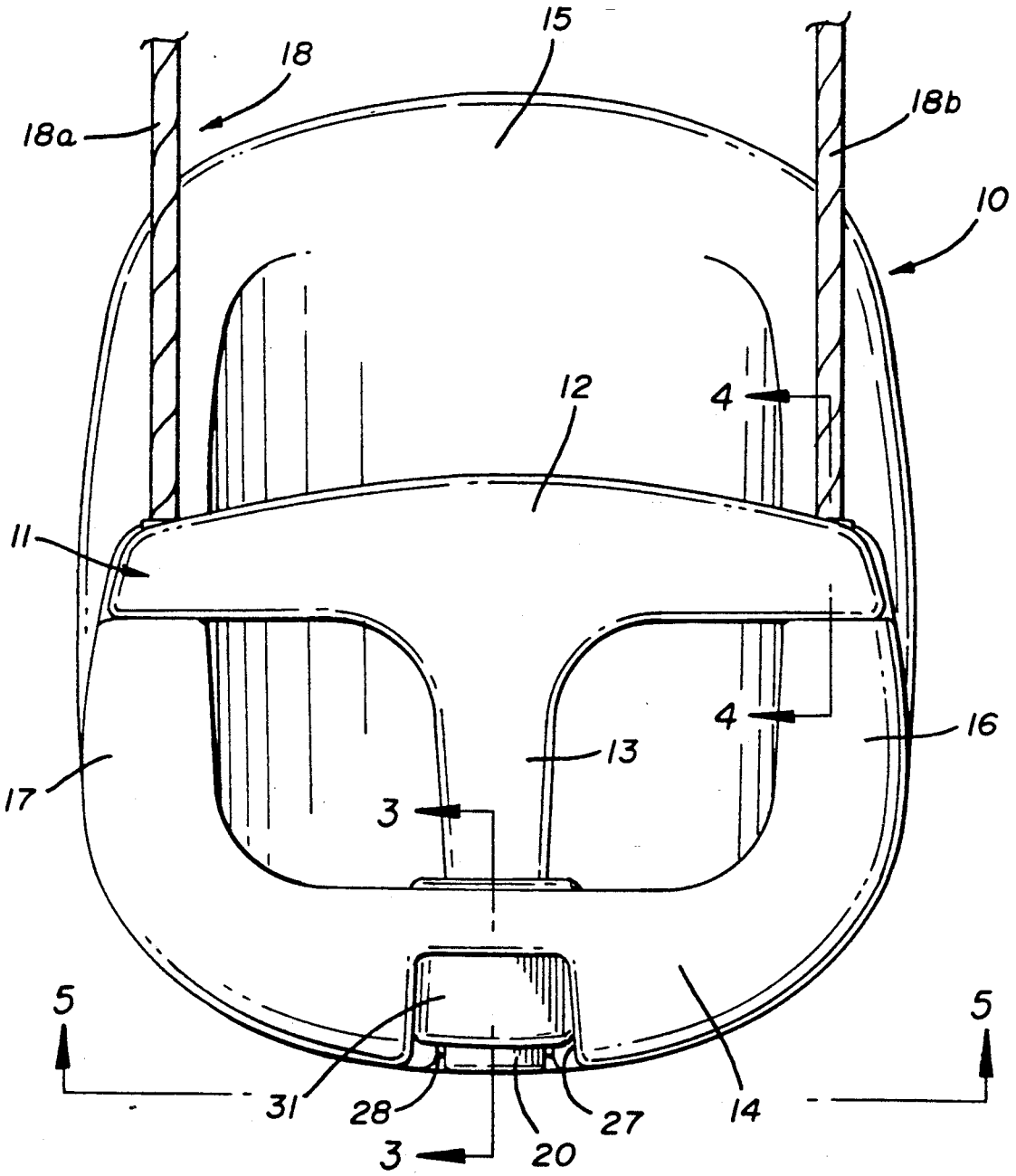
FIG. 2 is a front elevational view showing the restraining assembly of the swing of FIG. 1 in an engaged position.

A toddler swing made in accordance with the concepts of the present invention is generally indicated by the numeral 10 and includes a restraining bar assembly, generally indicated by the numeral 11, which may be selectively engaged and disengaged from swing 10. Restraining bar assembly 11 is generally of the type known in the art as a T-bar, and accordingly, includes a generally elongated cross bar 12 and a lower extension member 13 extending downwardly therefrom, generally so as to form the leg of T-bar 11. Swing 10, as shown, includes a seat 14 with a back rest 15 and arm rests 16 and 17 extending upwardly therefrom- A set of ropes 18 extend upwardly from back rest 15 and arm rests 16 and 17 from which swing 10 may hang.

T-bar 11 is engaged to swing 10 by a latch mechanism generally indicated by the numeral 19 and best shown in FIG. 3. As detailed in the drawings, latch mechanism 19 includes a spring member 20 positioned beneath and biased against seat 14 to engage lower extension member 13 at its lower end. Spring member 20 may be any type of spring having the ability to engage lower extension member 13 as described hereinbelow, and is preferably an elongated tension spring of generally arcuate configuration having an essentially J-shaped catch 21 at one end and an elongated tail 22 at its other end.

To latch T-bar 11 to seat 14, lower extension member 13 is positioned through an opening 23 defined in seat 14 which communicates with spring member 20. As lower extension member 13 is lowered into opening 23, it contacts spring member 20 at catch 21. Lower extension member 13 is designed at its lower end to slide over catch 21 so as to snap into place around catch 21. As illustrated in FIGS. 1 and 3, the lower end of lower extension member 13 may have a cavity 24 carved out of it so as to generally define a J-shaped hook 25. It should be appreciated, however, that hook 25 need not be defined by cavity 24, it being understood that any locking or latching feature at the end of lower extension men, her 13 will suffice.

Spring member 20 is thus bent outwardly at catch 21 to accommodate the incoming lower extension member 13. In doing so, tail 22 is generally flattened as spring member 20 bends. In order to provide strength to catch 21, a centrally extending support rib 26 may be integrally formed with spring member 20 and traversing catch 21.

It is noted that spring member 20 is generally encompassed within the periphery of seat 14, thereby not subjecting latch mechanism 19 to accidental manipulation. A recess 27 is provided in seat 14 which generally encompasses the entirety of latch mechanism 19 as can be seen in FIG. 3. As more clearly shown in FIG. 5, spring member 20 is held in position beneath seat 14 in recess 27 by an axle 28 which is received through a hub 29 formed integrally on spring member 20. Axle 28 extends through the walls forming recess 27 and is held in place by end caps 30. Thus, catch 21 of spring member 20 is generally pivotable about axle 28.

Figure 5:
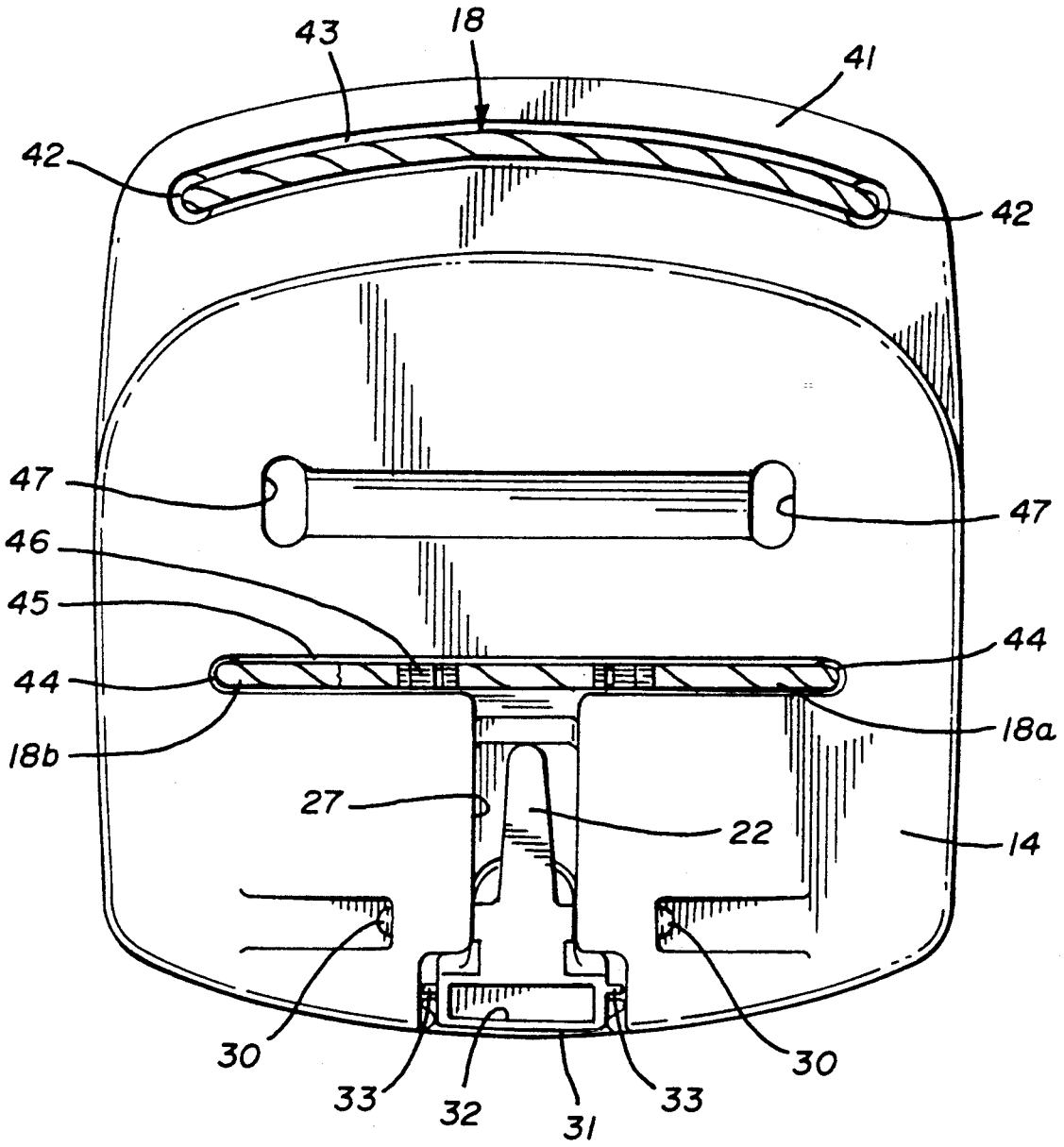
FIG. 5 is a bottom plan view of the swing of FIG. 1 taken along the line 5—5 of FIG. 2.

To disengage lower extension member 13 from spring member 20, and more particularly hook 25 from catch 21, a handle 31, shown in FIGS. 3 and 5 as integrally extending from catch 21, is provided. In the preferred embodiment, the walls of handle 31 define a cavity 32 in which the person releasing latch mechanism 19 may place his fingers to manipulate handle 31. By pulling outward, catch 21 is forcefully manipulated to disengage and release hook 25. T-bar 11 can then be lifted from opening 23 and slid upward along ropes **18*a*, 18*b* positioned toward the front of swing 10**.

It will be appreciated that handle 31 may further include clips 33 extending from either end of handle 31 which help to keep it in place within recess 27. Thus, it is noted that handle 31 is also positioned in a manner such that it does not extend beyond the general contours of seat 14.

Latch mechanism 19 is not the only means by which T-bar 11 is secured to swing 10, however. Cross bar 12 also includes guide members, such as bosses 34, to align and position cross bar 12 with arm rests 16 and 17 of swing 10. A boss 34 extends downwardly near each end of cross bar 12 to not only align cross bar 12, but also to prevent T-bar 11 from being pushed forward in a manner which may be dangerous to the child secured in swing 10. Moreover, the positive engagement of cross bar 12 and arm rests 16 does not permit T-bar 11 to be moved significantly in any horizontal direction when restraining bar assembly 11 is engaged with swing 10.

Bosses 34 may extend downwardly from the bottom of cross bar 12 and may be of any shape or configuration suitable for use in the present invention so long as they meet the requirements of the invention. In the preferred embodiment, bosses 34 are generally located near the rear of cross bar 12 so that at least one wall forming each boss 34 extends upward as part of the side wall 35 of cross bar 25. A hole 36 is provided through each boss 34 and extends upwardly through the top wall 37 of cross bar 12 through which ropes 18 are received. Thus, when restraining bar assembly 11 is disengaged from swing 10, cross bar 12 remains slidably connected to ropes 18.

A recess 38 is generally provided within each arm rest 16 and 17 to receive bosses 34. More particularly, each recess 38 is generally defined by a lip 39 which may form the end of arm rests 16 and 17. Another hole 40 is defined within recess 38 through which rope 18 is received so as to hold swing 10 as described herein. Thus, when engaging restraining bar assembly 11 to swing 10, bosses 34 extend into and communicate with recess 38, thereby aligning restraining bar assembly 11 with arm rests 16 and 17. Specifically, each recess 38 has generally the same shape and configuration as each boss 34 so as to complement it. Thus, as bosses 34 are received by recesses 38, their walls may come into adjacent contact with the walls defining lip 39. Furthermore, in the preferred embodiment, lip 39 abuts the bottom of cross bar 12, and recess 38 of each arm rest 16, 17 communicates with its respective complementary boss 34 of cross bar 12 in a manner such that top wall 37 of cross bar 12 is contiguous with the upper surface of arm rests 16, 17.

While only one particular embodiment of swing 10 is depicted in the drawings and described herein, it should be appreciated that any conventional toddler swing which satisfies the objects of the present invention may be employed. Thus, while the preferred swing 10 is made of double-walled construction from durable, weather resistant plastics, other conventional designs and suitable materials may be employed without departing from the scope of the invention.

Thus, as in most conventional swings, an elongated support rib 41 extends horizontally from back 15 and includes a pair of holes 42 through which ropes 18*c* and 18*d* are received. As shown in FIG. 5, support rib 41 may include a relatively narrow groove 43 in its bottom surface to contain the continuous rope 18. Similarly, ropes 18*a* and 18*b* which extend through arm rest holes 40 may further extend through holes 44 in seat 14 which communicate with a narrow groove 45 in seat 14 so that ropes 18*a* and 18*b* may be secured together, as at 46. Thus, rope 18 is one continuous member.

It should also be appreciated that, as shown in FIG. 5, seat 14 may have other features with do not generally fall within the scope of the invention. For example, seat 14 could have drain holes, such as at 47, for greater durability and weather resistance.

It should thus be evident, in view of the foregoing disclosure, that a swing employing a restraining bar assembly constructed according to the concepts of the present invention, as described herein, accomplishes the objects of the invention and other-wise substantially improves the toddler swing art.

We claim:

1. A restraining bar assembly for a toddler swing, the swing having a seat and arm rests, comprising a T-bar including a cross bar and a lower extension member, a latch mechanism for connecting said lower extension member to the seat of the swing, said latch mechanism including spring means attached to and biased against the seat of the swing for engaging said lower extension member, said spring means including a tail contacting the seat for biasing said spring means against the seat, and positioning guide means for securing said cross bar to the arm rests of the swing.

2. A restraining bar assembly according to claim 1 further comprising a generally J-shaped hook formed at the end of said lower extension member, said spring means further including a generally J-shaped catch at one end thereof to engage said hook.

3. A restraining bar assembly according to claim 2, wherein said latch mechanism further includes a handle integrally attached to said J-shaped catch, said handle capable of being manipulated to disengage said catch from said hook.

4. A restraining assembly according to claim 1, wherein said positioning guide means includes a boss formed near each end of said cross bar and further comprising a recess in each said arm rest to receive a said boss.

5. A toddler swing comprising a seat having arm rests extending upwardly therefrom, a restraining bar assembly having across bar and a lower extension member, means on said cross bar for positively engaging said arm rests to prevents aid cross bar from being significantly moved horizontally, and a latch mechanism for connecting said lower extension member to said seat, said latch mechanism having spring means positioned beneath and biased against said seat for releasably engaging said lower extension member.

6. A toddler swing according to claim 5, wherein said means on said cross bar includes bosses extending downwardly from each end of said cross bar, and further comprising recesses formed within said arm rests such that said bosses can be positioned within said respective recesses when said restraining bar assembly is in its engaged position.

7. A toddler swing according to claim 5, further comprising a generally J-shaped hook at the end of said lower extension member, said spring means including a generally J-shaped catch so that said catch and said hook may engage one another to lock said lower extension member to said seat.

8. A toddler swing according to claim 7, wherein said latch mechanism further includes handle means integrally formed with said spring means for releasing said catch from said hook of said lower extension member.

9. A toddler swing according to claim 5, further comprising means to hang said swing, wherein at least part of said means to hang is received through said cross bar and said arm rests.

10. A toddler swing according to claim 9, wherein said swing further includes a back and said means to hang said swing is received through said seat and an extension in said back.

11. A toddler swing according to claim 5, wherein said seat has a recess therebeneath so that said latch mechanism is completely encompassed within the contours of said seat.

12. A restraining bar assembly for a toddler swing, the swing having a seat and arm rests, comprising a T-bar including a cross bar and a lower extension member, a latch mechanism for connecting said lower extension member to the set of the swing, said latch mechanism including spring mean attached to and biased against the set of the swing for engaging said lower extension member, and positioning guide means for securing said cross bar to the arm rests of the swing, said positioning guide means including a boss formed near each end of said cross bar, said arm rests each having a recess therein for receiving a said boss.

* * * * *

UNITED STATES PATENT AND TRADEMARK OFFICE

CERTIFICATE OF CORRECTION

PATENT NO. : 5,334,099

DATED : August 2, 1994

INVENTOR(S) : Marra et al.

It is certified that error appears in the above-identified patent and that said Letters Patent is hereby corrected as shown below:

Claim 4, column 5, line 54, insert the word "bar" between the words "restraining" and "assembly".

Claim 5, column 6, line 8, "prevents aid" should be "prevent said".

Claim 12, column 6, line 47, "set" should be "seat".

Claim 12, column 6, line 48, "mean" should be "means".

Claim 12, column 6, line 49, "set" should be "seat"

Signed and Sealed this

Ninth Day of April, 1996

Bruce Lehman

*Attest:*

BRUCE LEHMAN

*Attesting Officer*

*Commissioner of Patents and Trademarks*